US008302219B2

(12) United States Patent
Tang et al.

(10) Patent No.: US 8,302,219 B2
(45) Date of Patent: Nov. 6, 2012

(54) PORTABLE AND HANDICAP ACCESSIBLE SHOWER STALL

(76) Inventors: Shilong Tang, Midlothian, VA (US); Zhenxing Zhang, Midlothian, VA (US); Ivory Jenny Tang, Midlothian, VA (US); Waverly Vivian Tang, Midlothian, VA (US)

( * ) Notice: Subject to any disclaimer, the term of this patent is extended or adjusted under 35 U.S.C. 154(b) by 245 days.

(21) Appl. No.: 12/856,561

(22) Filed: Aug. 13, 2010

(65) Prior Publication Data

US 2012/0036627 A1 Feb. 16, 2012

(51) Int. Cl.
*A47K 3/022* (2006.01)
*A47K 3/28* (2006.01)

(52) U.S. Cl. ..... 4/604

(58) Field of Classification Search ..... 4/509, 600, 4/607, 612, 614, 599, 604, 608, 609
See application file for complete search history.

(56) References Cited

U.S. PATENT DOCUMENTS

| | | | | |
|---|---|---|---|---|
| 1,495,413 | A * | 5/1924 | Hopponen | 4/600 |
| 1,990,871 | A * | 2/1935 | Klocke | 4/600 |
| 4,141,486 | A * | 2/1979 | Nilsen | 229/198.1 |
| 4,757,561 | A | 7/1988 | Crump | |
| 7,047,576 | B2 * | 5/2006 | Tavivian | 4/596 |
| 7,231,673 | B1 | 6/2007 | Arnold et al. | |
| 2008/0040851 | A1 | 2/2008 | Jackson | |

* cited by examiner

*Primary Examiner* — Huyen Le

(57) ABSTRACT

A portable shower stall suitable for a wheelchair-bound person to bathe with the help of an assistant, comprising of a self-supporting flexible shower base, a modular shower enclosure standing freely within the shower base, a hand-held sprayer connected to a kitchen faucet via hose, and a pump with puddle scoop attachment that drains the shower base. One sidewall of the shower base can be pressed down and fastened to the shower base bottom to facilitate wheelchair access, but it can be released and restored to upright position for water retention. Shower enclosure consists of two identical bi-fold shower screens clamping to each other to form a splash-proof rectangle. However, one or both screens can be removed from the shower base to provide access to the wheelchair-bound person.

3 Claims, 9 Drawing Sheets

PORTABLE AND HANDICAP ACCESSIBLE SHOWER STALL

FIELD OF THE INVENTION

The present invention relates to a portable shower stall that allows a wheelchair-bound person to be rolled in to take a shower with the help of an assistant. The stall can also be used for emergency decontamination showering and indoor pet showering. The stall is meant to be taken apart and transported easily.

BACKGROUND OF THE INVENTION

Taking a shower is difficult for a wheelchair-bound person. Yet it's even more challenging when the person goes on travel, such as visiting family and friends, or receiving medical treatment away from home. A portable shower stall would be useful under those circumstances. Homecare professionals would also find the stall useful as they can take it to their customers' home and provide bathing assistance.

There are several types of prior arts addressing the showering needs of invalids.

U.S. Pat. No. 4,757,561 demonstrated a portable platform that can be put into the shower pan of a conventional shower stall. The platform would raise the floor elevation. A ramp is connected to the platform. The combination of platform and ramp would provide access for a wheelchair. The usefulness of this prior art is limited by the fact that a typical shower stall simply does not have the proper physical size to allow a wheelchair to be rolled in.

US Publication No. 20080040851 represents another type of shower stalls that usually involve a rigid shower pan for waste water containment and a frame structure mechanically fastened to the shower pan to form a shower enclosure. In this prior art, a hollow but rigid shower base is proposed. Wheelchair stays on top of the base and stays dry. Waste water is contained down below in the base. Frame posts for the shower enclosure are mounted on the shower base. This set of setup is difficult to be transported. They are bulky and require complex assembling and disassembling.

U.S. Pat. No. 7,231,673B1 described a portable shower stall for handicap use, featuring a folding shower enclosure and soft base tray for waste water collection. Under closer examination, this prior art has several drawbacks:

1. Referring to FIG. 1 of this prior art, the shower enclosure frame 12 has only three panels—two side panels 18 and one rear panel 16. The front side of the enclosure is left open, and therefore, would allow water spray to escape during shower;

2. The base tray 30 is complete by fastening the front flap 36 to the side flaps 34 with the two hook-and-loop fasteners 38. Hook-and-loop fasteners are generally not used in watertight applications;

3. The front flap 36, which is made of flexible plastic material, lacks support between the fasteners 38. Its sagging could compromise the water holding capability of the base tray 30. Some sort of supporting rail could be added to the frame 12 to give the front flap something to be wrapped onto, at the expense of more work for the user.

The flaps of the base tray need to be wrapped onto the frame before the shower and unwrapped after the shower. All the work takes place at floor level, where the base tray stays. In the present invention, this work is entirely eliminated.

BRIEF SUMMARY OF THE INVENTION

The present invention overcomes the drawbacks of prior arts by using a flexible, watertight, and self-supporting shower base, and free-standing, splash-proof, modular shower enclosure consists of two identical folding shower screens that clamp to each other.

The shower base is a rectangular water pool made of flexible plastic material and it supports itself on the floor by having flexible plastic foam blocks embedded into the sidewalls. One sidewall can be pressed down and fastened via hook-and-loop to the bottom of the shower base. This allows the wheelchair to enter the shower base with little barrier. Then, the sidewall is unfastened from the shower base. The foam inserts within the sidewall will restore the wall to its original upright position for water retention. The fastening and unfastening of the sidewall can be done by a person using his/her feet.

Two free-standing, bi-fold shower screens with pre-mounted shower curtains are placed individually into the shower base. They can be joined together by pressing the build-in snap clamps. Gaps between the screens would be closed by the snap clamp. Yet, the modular nature of using two screens allows one or both screens to be taken out of the shower base so that the assistant can reach any parts of the wheelchair-bound person during shower without barriers.

Shower water is supplied via a hand-held sprayer, which is hose connected to a kitchen faucet, or any other suitable water supply such as a tub.

Waste water in the shower base is removed via a water pump with a puddle scoop attachment placed in the shower base and a discharge hose to a sink or toilet. In another embodiment, the shower base has a tab formed at the bottom. The drain hose without the puddle scoop attachment is inserted into the tab so that it would remain substantially at the bottom of the shower base. After the shower base is dewatered, it can be folded up and stored in a bag.

DETAILED DESCRIPTION OF THE PREFERRED EMBODIMENT

Figure 1:
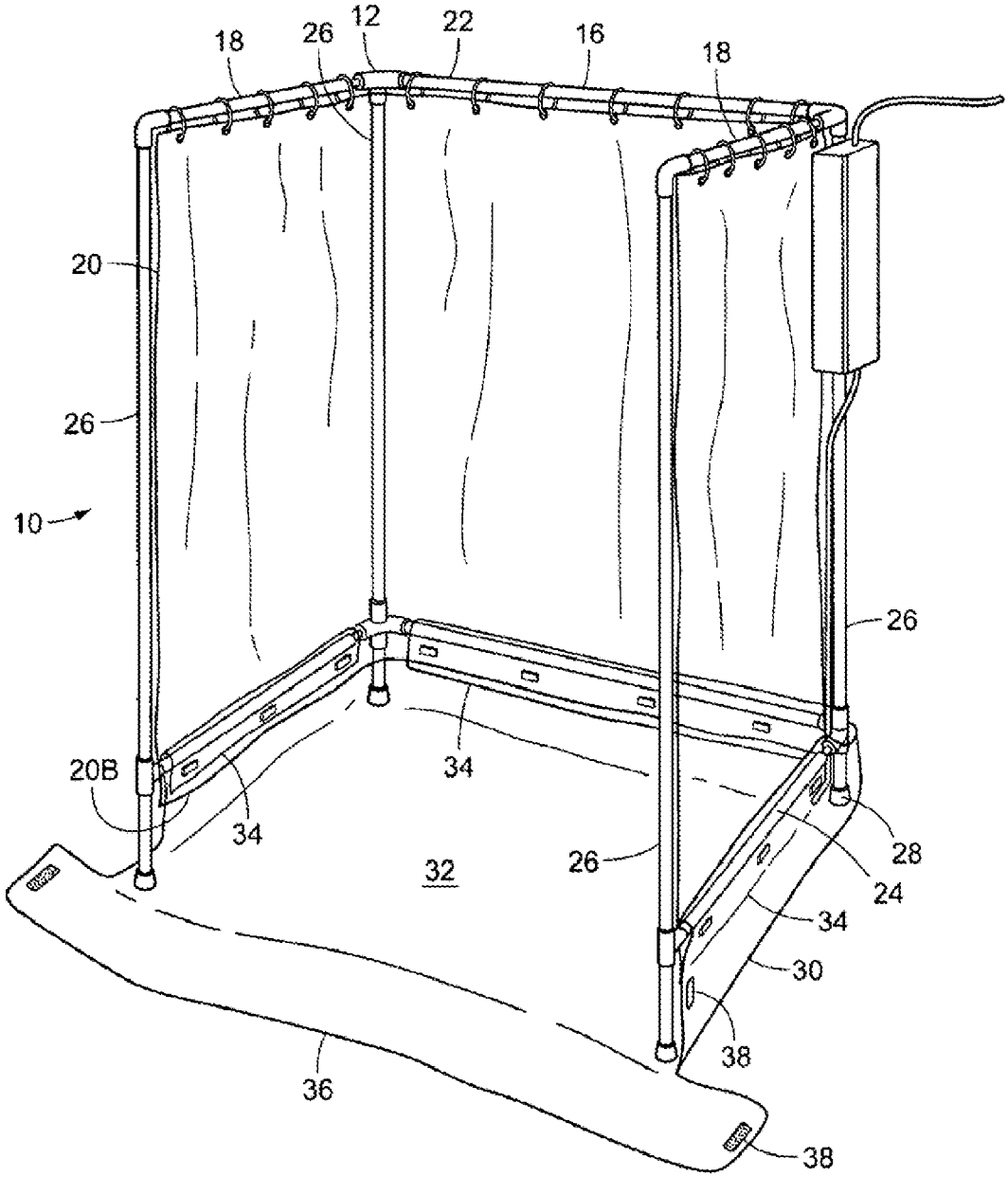
FIG. 1 Prior Art
FIG. 1 is a perspective view from U.S. Pat. No. 7,231,673B1.
Figure 2:
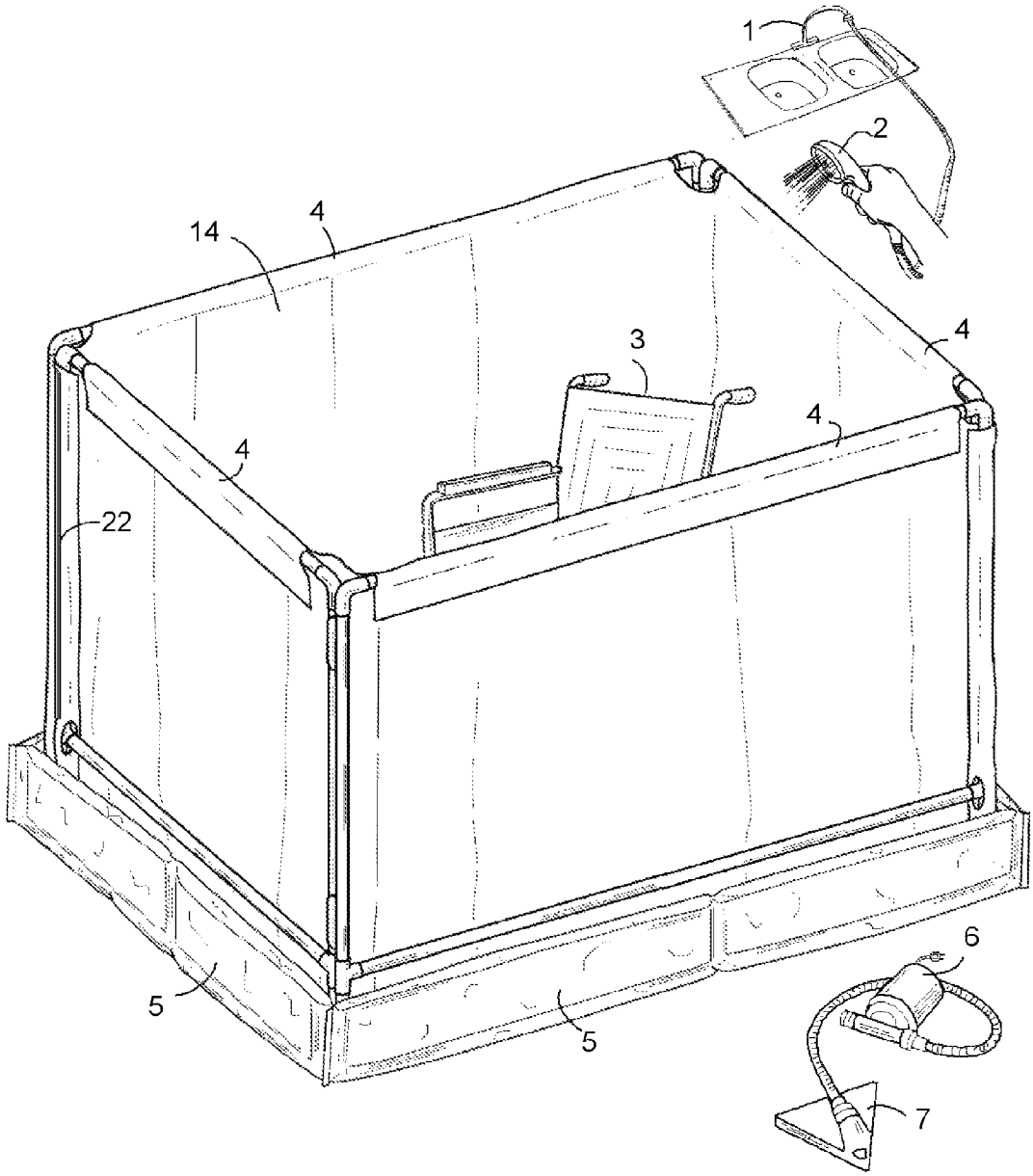
FIG. 2 is a perspective view for the present invention.

Referring to FIG. 2, two identical folding shower screens 4 are clamped together to form a rectangular shower enclosure and placed inside the shower base 5. From this angle, only one snap clamp 22 is shown. Each screen 4 has one snap clamp 22. A wheelchair 3 is located within shower base 5. A hand-held shower sprayer 2 shown here is connected to a kitchen faucet 1. But it can be connected to any suitable water supply, such as a tub. A puddle scoop 7 of a pump 6 is placed in the shower base 5 during or after the shower. The pump 6 discharges waste water in the shower base 5 to a kitchen sink.

Figure 3:
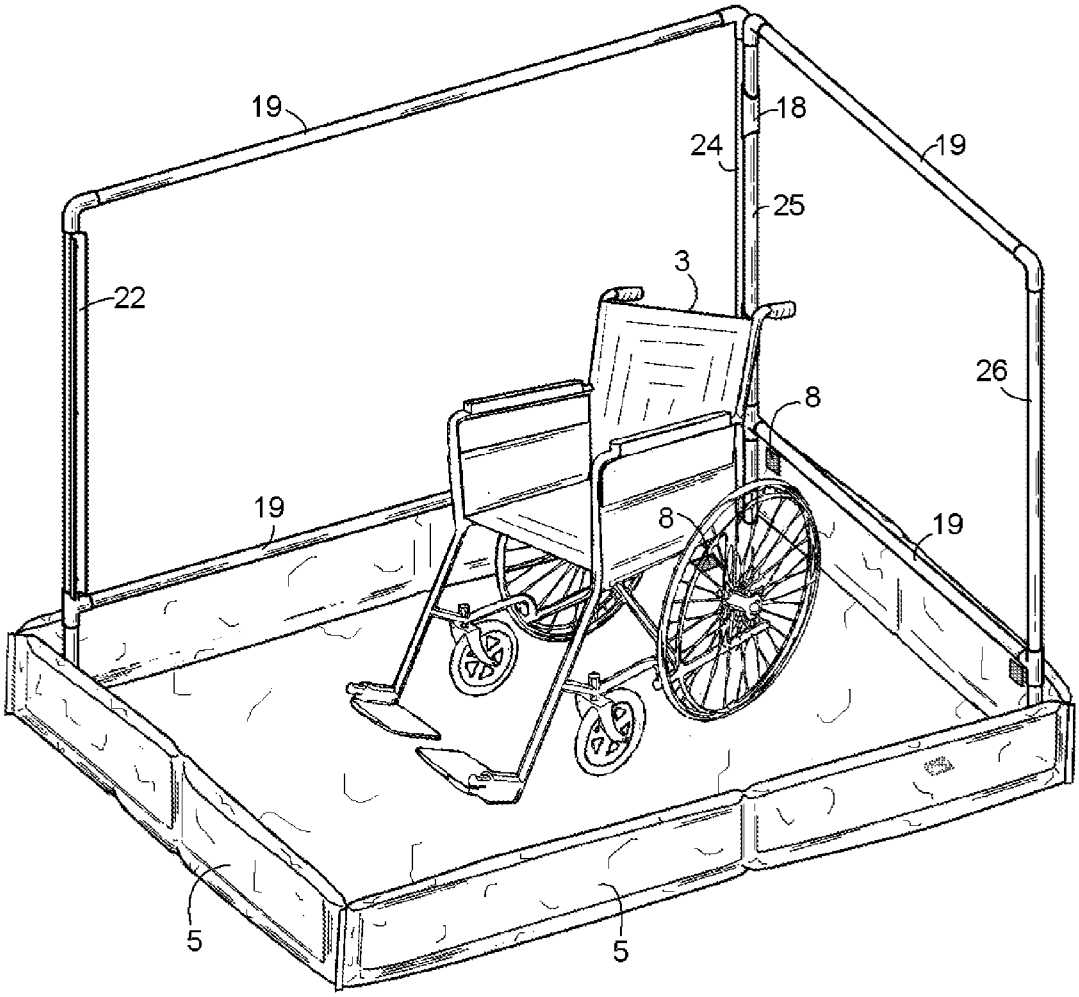
FIG. 3 illustrates the relative size of the shower base 5 and the shower screen comparing to a wheelchair is shown. One shower screen is taken out of the base to expose the wheelchair.

In FIG. 3, one shower screen 4 is removed from the base 5. Also, the shower curtain 14 on the remaining screen is removed to expose more detail. The shower base 5 rests on the floor and supports itself. The screen is placed in the base in a free-standing way. When necessary, the assistant can remove one or both screens 4 to gain access to hard-to-reach areas while bathing the wheelchair-bound person.

Figure 4:
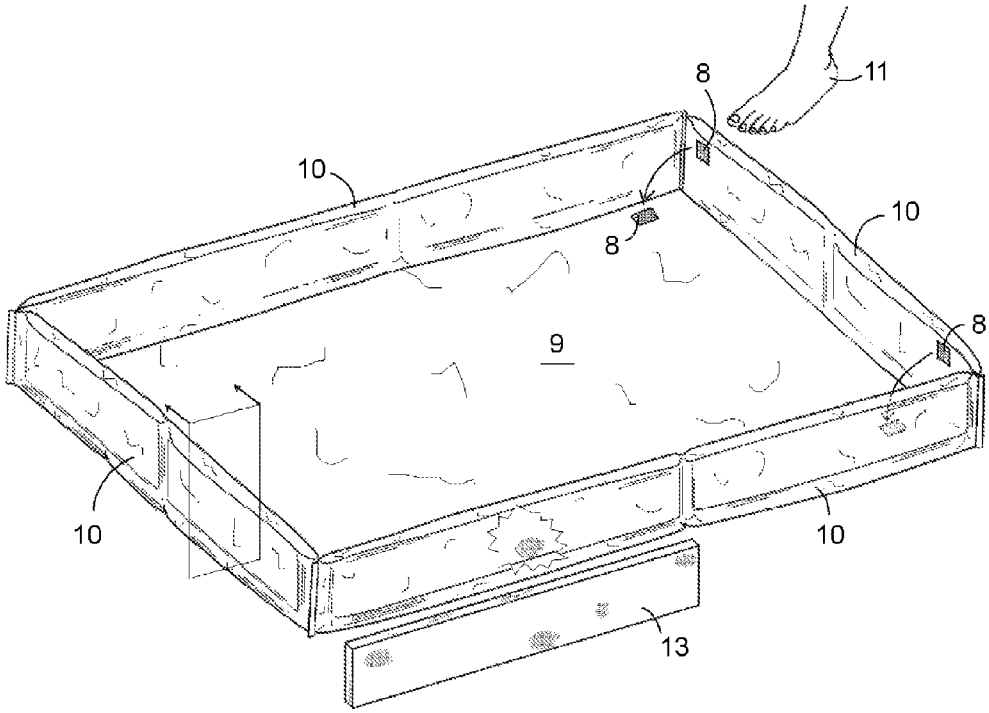
FIG. 4 is a perspective view of the shower base showing the plastic foam insert blocks 13 and the hook-and-loop fasteners 8 located on one sidewall 10 and the bottom 9. Another embodiment of the shower base shows a tab 27 permanently bonded to the bottom of the base. A drain hose 28 is inserted into the tab 27.
Figure 5:
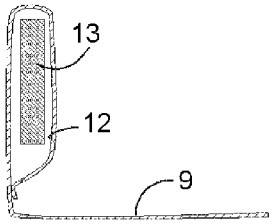
FIG. 5 is a cross-section view of the shower base showing how foam inserts embedded into the sleeves 12 of the sidewalls.
Figure 6:
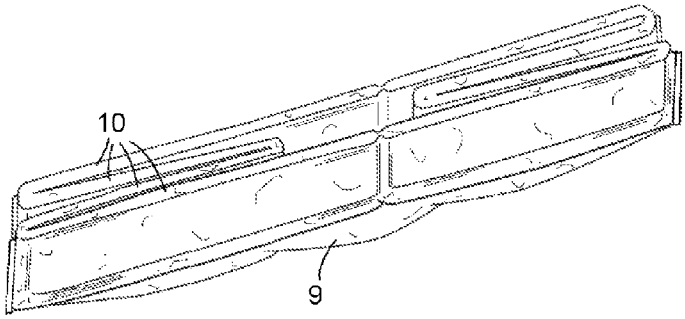
FIG. 6 shows the shower base folded and ready to be put into a bag.

As shown in FIG. 4, the shower base 5 is made of flexible plastic material. It has a flat bottom 9, and sidewalls 10, all joined in a watertight fashion. The sidewalls have sleeves 12 built in. Flexible plastic foam blocks 13 are inserted into the sleeves and the sleeves are sealed watertight. A cross-section of the sidewall is shown in FIG. 5. The foam blocks will support the sidewalls 10 in their upright position, but they are flexible enough to be bent. Hook-and-loop fasteners 8 are placed on the inner side of a sidewall and on the base bottom 9. When pressed down by a human foot 11, the sidewall will be forced to bend down to be parallel to the base bottom 9 and the hook-and-loop fasteners 8 will hold the sidewall from bouncing back. After the sidewall becomes substantially flat to the floor, its height is reduced, and a wheelchair is rolled in with little barrier. To release the sidewall 10 from the base bottom 9, a person can kick the sidewall 10 near the hook-and-loop fasteners 8 in a direction that is away from the base bottom 9. After hook-and-loop fasteners 8 are opened, the foam inserts 13 would restore the sidewall to its original upright position and the shower base 5 is ready for water capture. By pressing two opposite sidewalls inward, the shower base can be folded as shown in FIG. 6. It can be stored in a bag.

Figure 7:
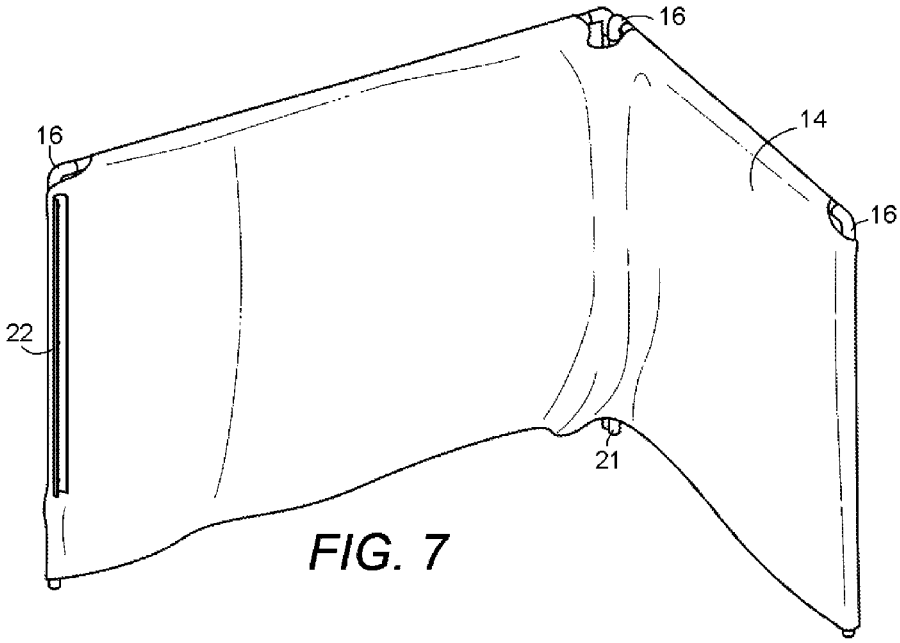
FIG. 7 is a perspective view of a shower screen when viewed from inside.
Figure 8:
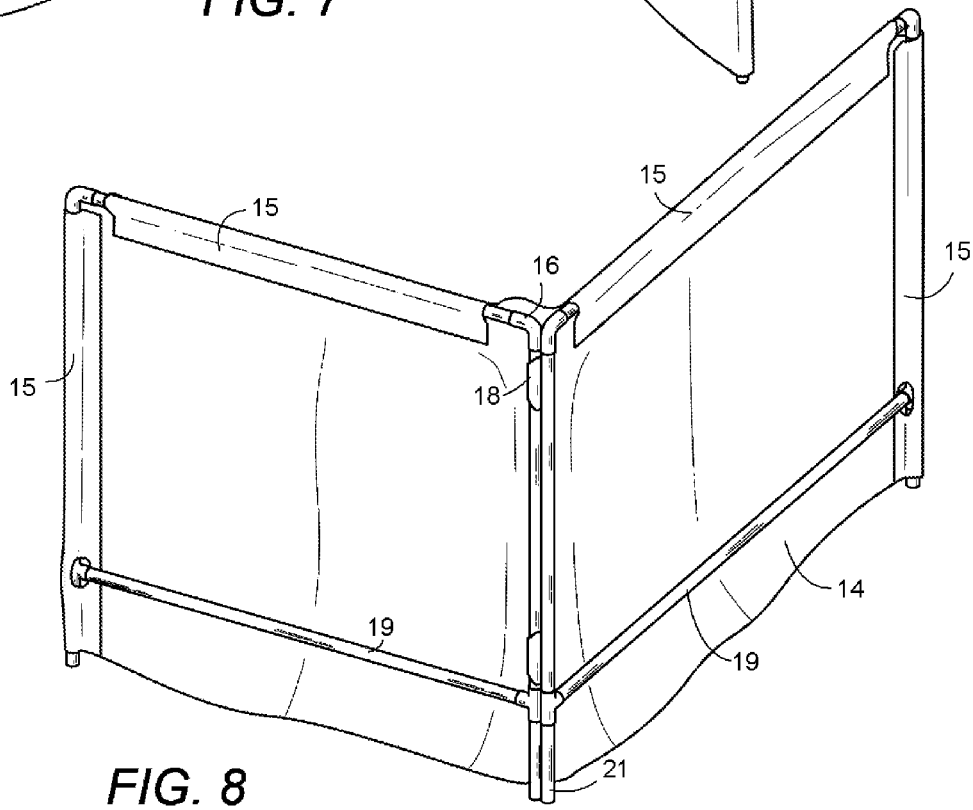
FIG. 8 is a perspective view of a shower screen when viewed from outside.

FIG. 7 and FIG. 8 show how the shower curtain 14, which is made from a single sheet of flexible, water repellent material, is mounted onto a shower screen. The curtain has sleeves 15 on the top and two sides. Openings are cut on the sleeves so that the screen can route through. The bottom edge of the shower curtain 14 should stay below the top edge of the shower base sidewall 10, so that shower splash is captured by the shower curtain 14 into the shower base 5.

Figure 9:
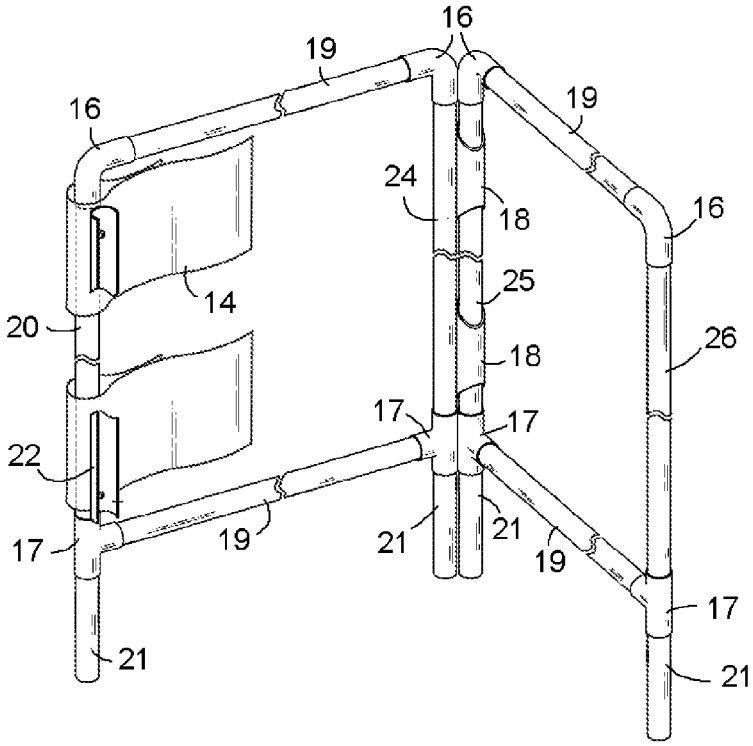
FIG. 9 shows the construction of a shower screen.

Turning our attention to the shower screen, we start with FIG. 9.

The entire screen, including the frame members 19, 20, 21, 24, 25, the hinges 18, the snap clamp 22, the 90-degree elbows 16, and the Tee fittings 17, is made from plastic pipes and pipe fittings commonly available in hardware stores.

The screen is bi-fold. Pipe 19, 20, 19, 24 form one panel (panel A). Pipe 19, 26, 19, form the other panel (panel B). Pipe 21 form the legs for both panels. One panel (panel B) is able to pivot approximately 180 degrees against the other panel (panel A).

Figure 10:
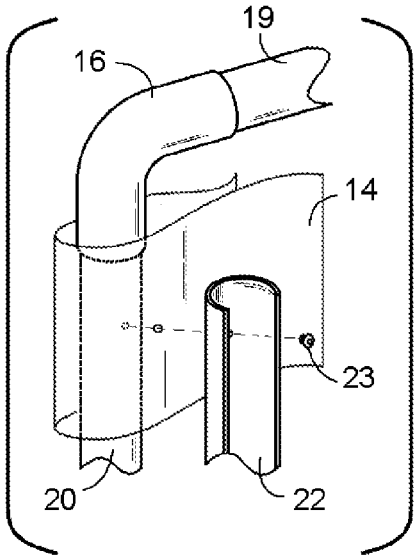
FIG. 10 shows how a snap clamp 22 is mounted onto the shower screen.

Rivets 23 are used to mount the snap clamp 22 to pipe 20. The snap clamp is on the outside of shower curtain sleeve 15 as shown in FIG. 10. The snap clamp covers the entire length between the elbow 16 and the Tee 17.

Figure 11:
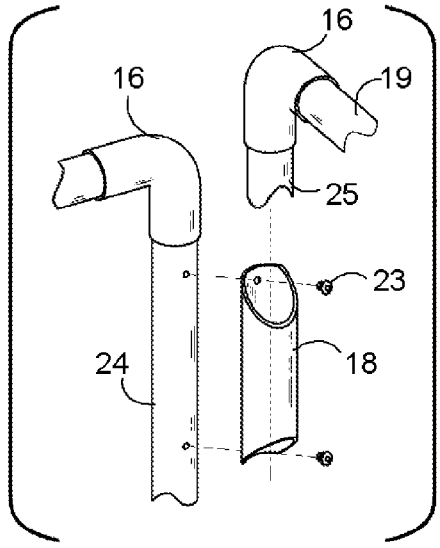
FIG. 11 is an exploded view of the hinge 18 that makes the shower screen foldable.

Each screen has two hinges 18. Hinges are pipe segments made from a pipe whose I.D. are slightly larger than the O.D. of frame pipes 25 so that the later can slide through the hinge. Each hinge 18 has two cut bevels at the ends to provide space for drilling holes and setting rivets. Two hinges are mounted on pipe 24 via rivets 23. Pipe 25 is inserted through both hinges 18. The detail is shown in FIG. 11.

The screen has four horizontal pipes 19 with slip socket fit on both ends. By removing the horizontal pipes 19 and leaving the rest (i.e., vertical pipes 20, 21, 24, 25, 26, shower curtain 14, snap clamp 22, hinges 18) untouched, the screen can be rolled into a bundle for transportation.

Figure 12:
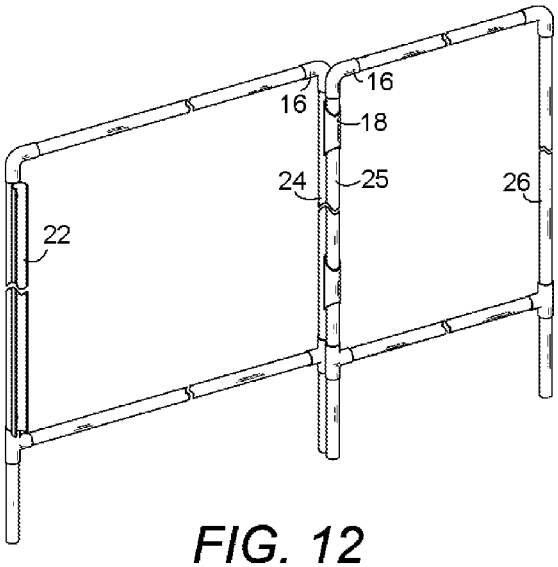
FIG. 12 shows a shower screen in fully opened position.
Figure 13:
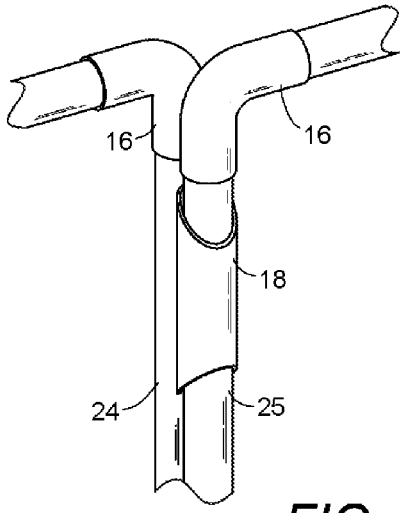
FIG. 13 is a detail view near the hinge 18 when the screen is fully open.
Figure 14:
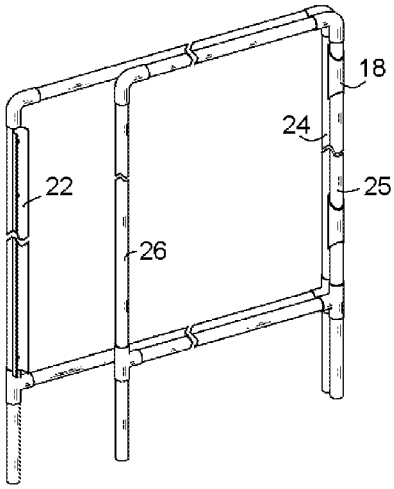
FIG. 14 shows a shower screen in fully closed position.
Figure 15:
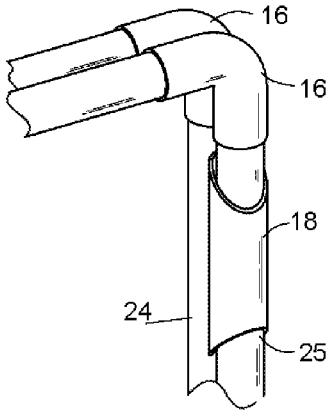
FIG. 15 is a detail view near the hinge 18 when the screen is fully closed.

The folding of the screen is shown in FIG. 12, 13, 14, 15. Pipe 25 pivots in the hinge 18. The two panels can be folded between 0-180 degrees.

Figure 16:
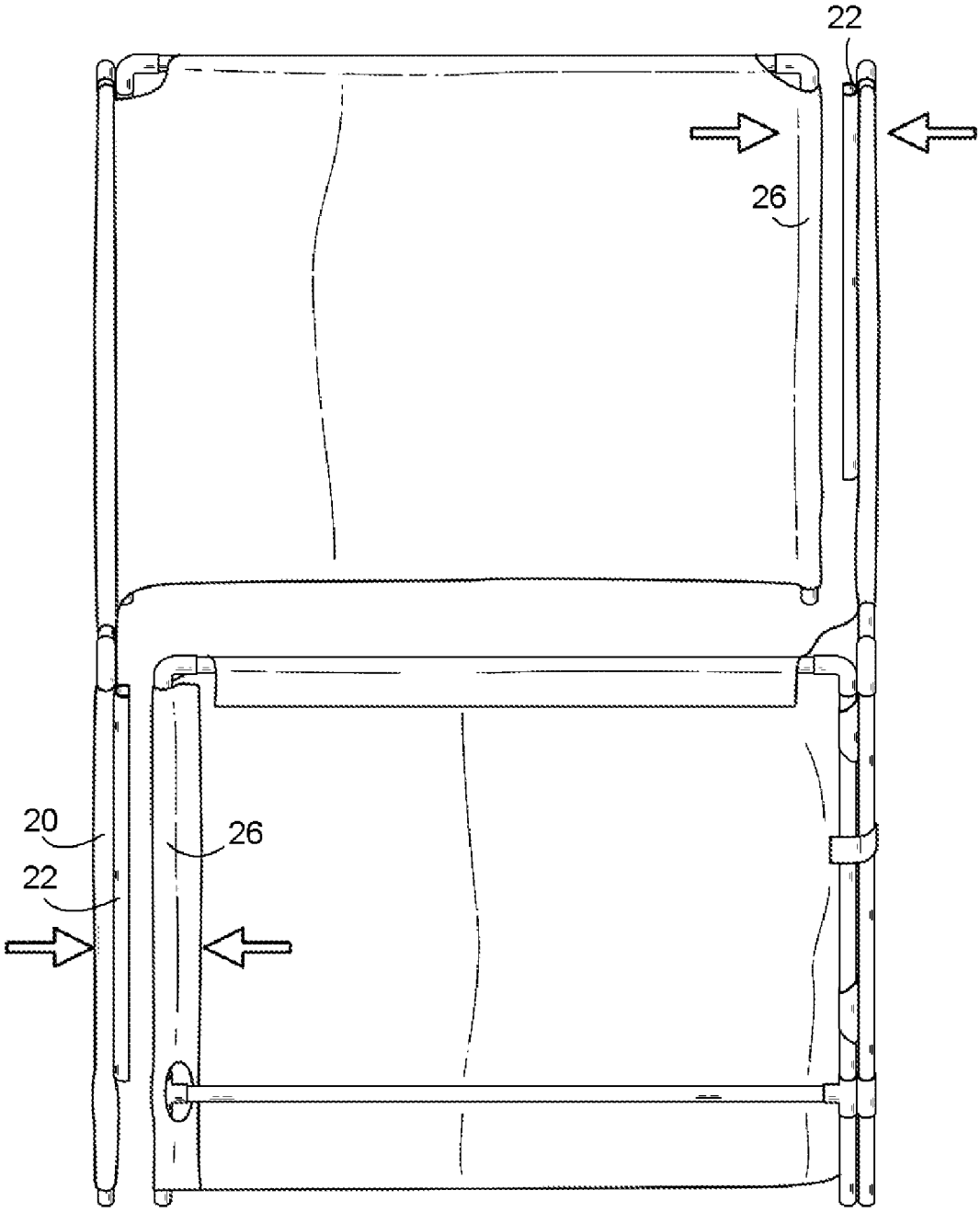
FIG. 16 shows how two shower screens form a complete shower enclosure.

In FIG. 16, two shower screens are ready to be clamp joined to form a complete shower enclosure. The two snap clamps 22 are pressed against pipe 26 and clamp onto it over the shower curtain 14. As the clamp closes, any gaps between the two screens are shut and shower sprays are trapped. Any water spray escaping between the screens below the snap clamps are met with the sidewall 10 of the shower base 5.

Figure 17:
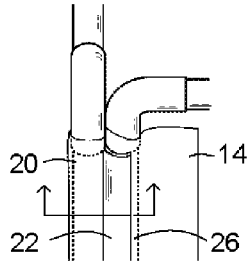
FIG. 17 is a side view of a snap clamp 22 in closed-in position.
Figure 18:
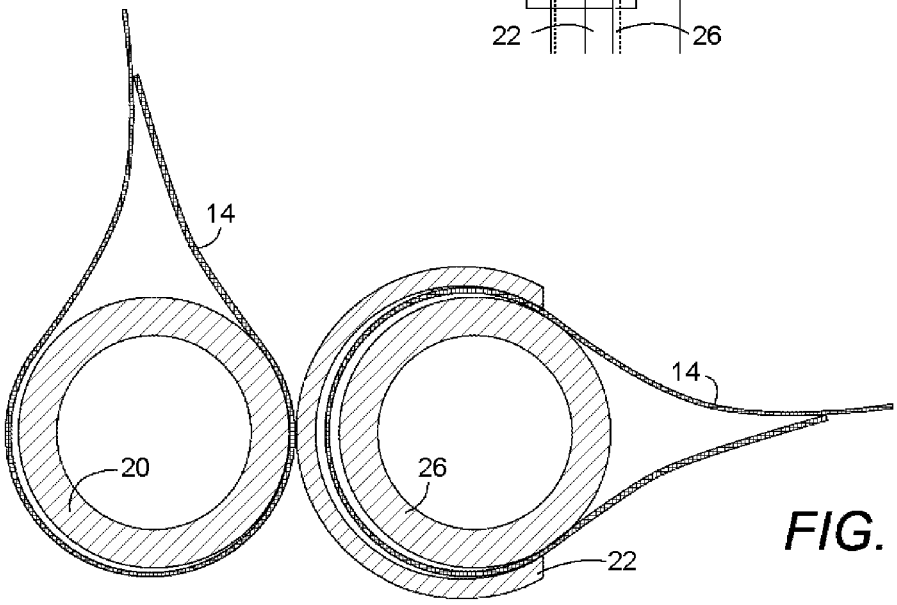
FIG. 18 is a section view of the snap clamp 22 and the adjacent pipes 20, 26.

FIG. 18 is a cross-section view of the snap clamp 22 when section is taken from the plane shown in FIG. 17. The snap clamp 22 is made from the same plastic pipe for hinges 18. An opening is cut longitudinally along the OD. The width of the opening is slightly smaller than the O.D. of pipe 26. When pressed, the opening of the clamp will be expanded slightly and slide onto pipe 26. The clamp is riveted onto pipe 20 over shower curtain 14, and gaps between pipe 20 and pipe 26 is effectively closed.

Figure 19:
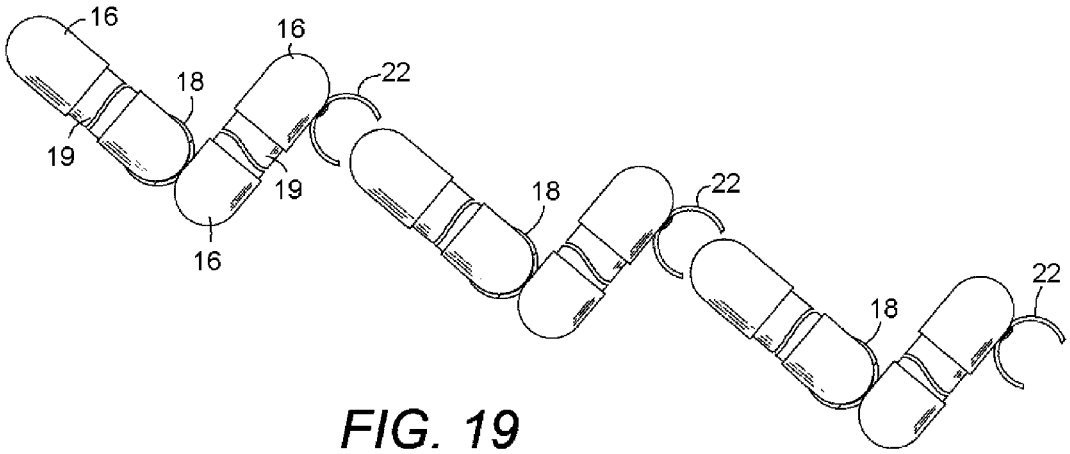
FIG. 19 shows three of the shower screens forming a zigzag screen after a slight change of the mounting position of the snap clamps 22.

The shower screens disclosed in the present invention can be used as a stand-alone portable shower enclosure for permanent ADA (American Disability Act) compliant showers, portable decontamination emergency showers. It can also be used as a privacy screen or a room partition divider by making minor changes such as the physical dimension and curtain material. FIG. 19 shows three screens are to be clamp joined to form a 6-panel zigzag screen simply by mounting the snap clamp 22 180 degrees from its current position.

What is claimed is:

1. A portable shower stall suitable for a wheelchair-bound person to bath with the help of an assistant, comprising: a self-supporting flexible shower base that lays on the floor for waste water collection and can be folded and stored in a bag for transportation; a modular shower enclosure, formed by two identical bi-fold shower screens clamped together, standing freely within the shower base; a hand-held shower sprayer that supplies water from a kitchen faucet or other sources; a pump with puddle scoop attachment that dewaters the shower base discharges to a sink; wherein the shower base has sidewalls embedded with foam and a shower base bottom, one of the side sidewalls is able to be pressed down and fastened to the shower base bottom to facilitate wheelchair access, and being able to restore to its original upright position for water retention when unfastened from the shower base bottom.

2. The portable shower stall according to claim 1, wherein the identical bi-fold screens include water-repellent curtains that are plash proof splash-proof and can be used as a stand-alone portable shower enclosure.

3. The portable shower stall according to claim 1, further comprises build-in snap clamp that can be slightly modified to form a zigzag, modular room partition or privacy screen.

* * * * *